United States Patent [19]

Chao

[11] 4,009,977

[45] Mar. 1, 1977

[54] APPARATUS FOR THE TRIAXIAL COMPRESSION OF PARTICULATE MATERIAL

[75] Inventor: Hung-Chi Chao, Monroeville, Pa.

[73] Assignee: United States Steel Corporation, Pittsburgh, Pa.

[22] Filed: Apr. 29, 1976

[21] Appl. No.: 681,310

[52] U.S. Cl. ..... 425/78; 425/405 H

[51] Int. Cl.[2] ..... B30B 5/02; B30B 11/00

[58] Field of Search ..... 425/78, 405 H

[56] References Cited

UNITED STATES PATENTS

| | | | |
|---|---|---|---|
| 3,462,797 | 8/1969 | Asbury | 425/405 H X |
| 3,830,607 | 8/1974 | Boxendale et al. | 425/405 H X |
| 3,933,418 | 1/1976 | Elmgren | 425/405 H |
| 3,956,452 | 5/1976 | Saito | 425/405 H X |

FOREIGN PATENTS OR APPLICATIONS

| | | | |
|---|---|---|---|
| 2,000,304 | 7/1971 | Germany | 425/405 H |
| 2,221,487 | 11/1972 | Germany | 425/405 H |
| 466,480 | 2/1971 | Japan | 425/405 H |

*Primary Examiner*—J. Howard Flint, Jr.
*Attorney, Agent, or Firm*—Arthur J. Greif

[57] ABSTRACT

Superior densification of particulate material is achieved by the superimposition of an axial load on material under isostatic pressure. Such an axial load is imposed through the use of a floating plunger, eliminating the need for an external compacting plunger inserted through the isostatic compacting cylinder. This floating plunger is composed of two end sections, having different surface areas. One end section is acted on by the pressurized media, while the other end section (generally the smaller) coacts on the compact. Pressurization of the chamber with an isostatic media, thereby results in a stress along the vertical axis of the compact, which is different from the isostatic stress on the circumferential surface of the compact.

5 Claims, 3 Drawing Figures

(PRIOR-ART)

APPARATUS FOR THE TRIAXIAL COMPRESSION OF PARTICULATE MATERIAL

This invention is related to an apparatus for the compaction of particulate material and is more particularly related to the economical modification of a conventional isostatic compression device, to provide for the application of an additional uniaxial shear component on said particulate material, so as to achieve a triaxial pressure state.

The compaction of particulate material, for applications in the ceramic and refractory field, in powder metallurgy, etc. is most commonly achieved through the use of uniaxial compression. Such compaction is characterized by the absence of a substantial lateral compacting force, since the particulate material does not exert a hydrostatic force perpendicular to its container. The only appreciable force exerted by the container on the material, is the retardation friction force parallel, but opposite to, the direction of the compacting load. Although this force exerted by the wall of the container does not contribute significantly to the compaction of the particulate material, it is responsible for undesirable density variations in the compact. Obviously, this variation of densification, from top-to-bottom, becomes more evident as the length to diameter ratio of the compact is increased. Thus, conventional uniaxial compaction cannot be employed to produce compacts with high length to diameter ratios. In such instances, isostatic compaction has been employed since it offers a uniform compacting pressure perpendicular to all surfaces of the particulate material undergoing compaction. In addition to uniformity of compaction, this latter method offers an additional advantage, in that the density of the compact is generally superior. Although isostatic compaction provides higher densities than those achievable with unidirectional compaction, throughout the applied pressure range, the most pronounced difference is evidenced at lower applied pressures. At higher pressures the difference in density response between the two compaction techniques becomes minimal. Thus, the densities achievable either by isostatic compaction alone, or by uniaxial compaction alone are very much limited and the achievement, in powder compacts, of theoretical full densities requires pressures (from either of these two methods) approaching infinity. As a result of these deficiencies in the above compaction methods, the art has recently employed a compaction technique which combines a conventional uniaxial plunger type press with an isostatic compacting cylinder, as shown in FIG. 1. This device achieves a state of triaxial pressurization by superimposing an additional shear component in an otherwise conventional isostatic compaction state. The difference in magnitude between the axial stress and that achieved by isostatic pressure, produces shear stresses throughout the specimen which are very effective in producing higher densities. The extra shear components help to adjust the relative position of the particles adjacent the voids in the compact, so that the compacting pressure can act to close the void at comparatively lower pressure levels. As shown in FIG. 1, however, the achievement of this extra shear component necessitated the utilization of external press equipment. The utilization of such an external compaction plunger, which inserts through the isostatic compacting cylinder, presents a serious problem in effecting a seal of the pressurized media; particularly so with the very high pressures at which these devices are designed to be employed.

It is therefore a principle object of this invention to provide an apparatus for effecting the triaxial compression of particulate material, while avoiding the need for an external plunger system.

This and other objects and advantages of the instant invention will be more readily understood by a reading of the following description, when taken in conjunction with the appended claims and the drawings in which:

Figure 1:
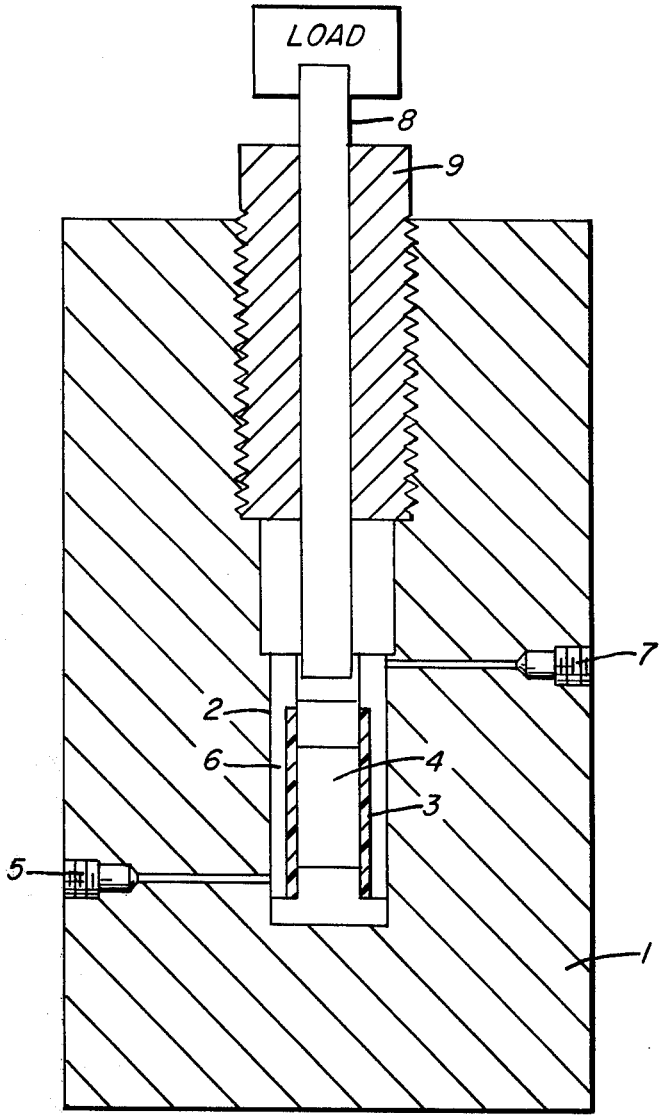
FIG. 1 is a representational drawing of a prior art apparatus for the superimposition of an axial load on a specimen which is under isostatic pressure.

The basic features of a prior art triaxial compaction device are shown in FIG. 1, wherein a conventional isostatic pressure vessel composed of an essentially nondeformable container 1 comprising a cylindrical bore 2. The tooling or bag 3 which contains the particulate material 4 is supported within the bore. An isostatic media (fluid or gas) is fed from an external isostatic pressure source (not shown) through inlet means 5 into chamber 6 whereby an isostatic pressure is exerted on the tooling and in turn on the circumferential surface of the particulate material contained therein. During pressurization, excess air is bled from the chamber through air-bleed 7. The achievement of an extra shear component is accomplished by modifying the system through the utilization of external plunger or piston 8 inserted through cap 9. It is readily seen that the stress state of the specimen may infinitely be varied by increasing or decreasing either (i) the axial load applied to the plunger, e.g. by utilization of the conventional press, or (ii) the pressure applied by the media through means 5.

Figure 2:
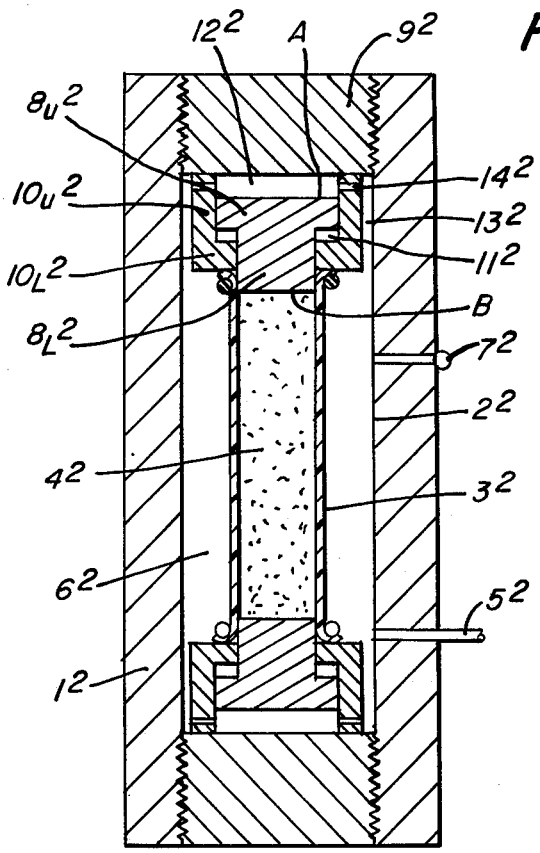
FIG. 2 illustrates a preferred embodiment of the instant invention, utilizing a floating plunger for achieving a superimposed axial load, eliminating the need of an external plunger system.

Referring to FIG. 2, it is seen in accord with the instant invention, that similar triaxial compression may be achieved by a comparatively simpler modification of a conventional isostatic compaction device. In a manner similar to that of the prior art, isostatic pressure from source $\mathbf{5^2}$ feeds pressurized media into chamber $\mathbf{6^2}$ thereby exerting compaction force on the particulate material $\mathbf{4^2}$ contained within tooling $\mathbf{3^2}$, which may be either conventional wet bag or dry bag tooling. The instant device departs from the otherwise conventional isostatic pressure vessel in the design of the cap $\mathbf{9^2}$ which may consist of conventional high pressure sealing thread for tightening the cap into the vessel to provide a proper seal. An essentially nondeformable floating plunger $\mathbf{8^2}$, composed of upper section $\mathbf{8_u^2}$ and lower section $\mathbf{8_L^2}$, is supported within $\mathbf{10^2}$, which is secured to the lower face of cap $\mathbf{9^2}$. Member $\mathbf{10^2}$ is composed of two sleeve portions: (i) sleeve portion $\mathbf{10_u^2}$ mates in fluid tight engagement with the perimetric surface of the plunger upper section and (ii) sleeve portion $\mathbf{10_L^2}$ mates in tight engagement with the perimetric surface of the plunger lower section. These sleeve portions and the plunger are dimensioned properly so as to provide a cavity $\mathbf{11^2}$ which is isolated from chamber $\mathbf{6^2}$.

The floating plunger has an upper surface A exposed to the isostatic pressure from the media in zone $\mathbf{12^2}$.

The lower surface B of the plunger, will therefore exert a pressure (equal to the area of A divided by the area of B, times the isostatic pressure of the media) directed uniaxially onto the particulate material compact. Thus, the particulate material receives an extra compacting component, equal to (area A/area B - 1) so as to provide a state of triaxial compression. Obviously, if the area A were equal to the area B, only isostatic compaction would result. Therefore, the ratio of A:B must be other than 1. While a state of triaxial compression could be achieved for ratios of A/B which are less than 1, for most commercial applications A/B will be greater than 1, and preferably be within the range 1.2:1 to 25:1. In operation a variety of triaxial compaction states may readily be achieved simply by varying (i) the ratio of the area of A to the area of B, (ii) the pressure within chamber $6^2$ or (iii) the back pressure in zone $11^2$ from an external pressure source (not shown). Additional loading may also be achieved by provision of an external piston inserted through cap $9^2$ in a manner analogous to that shown in FIG. 1. However, this latter feature is less preferred, since it would create the same problems as that of the prior-art device, i.e. in effecting a proper high-pressure seal. Pressurization of zone $12^2$ may be accomplished in a variety of ways. Thus, media may be supplied from a separate pressure source. However, it will generally be more desirable, as shown in FIG. 2, that this zone be connected to main chamber $6^2$, e.g. by passage $13^2$ and pressure equalization vanes $14^2$. Even greater control of the densification of the compact may be achieved by utilizing an optional floating plunger, (as shown in FIG. 2), at both ends of the compact.

Figure 3:
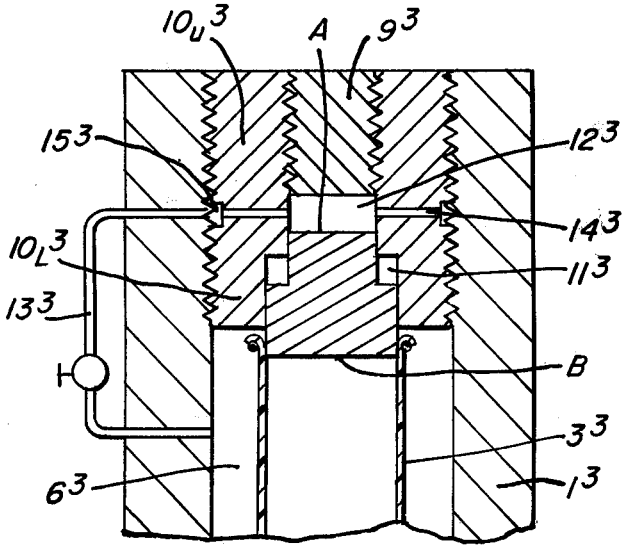
FIG. 3 shows a further embodiment, depicting an alternate means for supporting the floating plunger system of the instant invention.

Alternative embodiments for the achievement of pressurization and/or the support of a floating plunger system are shown in FIG. 3. Here, zone $12^3$ is exposed to the pressurized media through an external piping system $13^3$ and grooving $15^3$ which mates with vanes $14^3$ when the outer cap $10^3$ is screwed into position to seal the vessel. The capping feature shown here, employing an inner cap $9^3$ and an outer cap $10^3$, may be used to support the floating plunger either when A>B, or when A<B as illustrated.

I claim:

1. A triaxial compression apparatus for the compaction of particulate material feed, said apparatus comprising, a non-deformable enclosure, the inner portion of which defines a substantially right circular cylindrical bore, a non-deformable floating plunger axially disposed and supported within said bore approximal the upper end thereof, said plunger (i) being comprised of an upper section and a right circular cylindrical lower section, and (ii) having top and bottom planar surfaces perpendicular to the axis of said bore, the ratio of the area of the top planar surface of said upper section to the area of the bottom base surface of said cylindrical lower section being other than 1, said plunger lower section fitting slidably within a deformable tube supported within said bore, whereby said plunger bottom base surface forms the top surface of a confine for containing said feed, the outer diameter of said tube being smaller than the diameter of said bore, so that the annular region between the outer surface of said tube and the surface of said bore forms a chamber for containing media under pressure, said plunger being supported within a member having upper and lower sleeve portions, in which (i) the perimetric surface of the plunger upper section and the inner surface of the upper sleeve portion mate, and (ii) the perimetric surface of the plunger lower section and the inner surface of the lower sleeve portion, mate in fluid tight engagement to provide a cavity bound by said perimetric surfaces and sleeve portions, which cavity is isolated from said chamber, a non-deformable means sealing the lower end of said bore, said lower end seal means including a substantially right circular cylindrical element, the top base diameter of which is approximately equal to the inner diameter of said tube, said cylindrical element being fitted within said tube so that the top base surface of said element forms the bottom enclosure of said feed confine, a non-deformable capping means sealing the upper end of said bore, said capping means having a substantially planar surface oppositely facing said plunger top planar surface and being spaced therefrom a distance sufficient to permit ready ingress of said media in the region therebetween, means for the admission of media to said chamber, and means for the admission of media to said therebetween region, whereby upon pressurization, an isostatic pressure will be exerted on the circumferential surface of said tube while the pressurization of said therebetween region will exert a pressure on the top surface of said plunger upper section.

2. The apparatus of claim 2, wherein said chamber and said therebetween region are interconnected, whereby pressurization of said chamber will concomitantly pressurize said therebetween region.

3. The apparatus of claim 2, wherein the ratio of the area of the top planar surface of said plunger upper section to the area of the bottom base surface of said plunger lower section is within the range 1.2 to 25:1.

4. The apparatus of claim 3, including entrance means to said cavity for varying the mass of fluid therein.

5. The apparatus of claim 1, wherein said means sealing the lower end of said bore comprises, a second non-deformable floating plunger axially disposed within said bore approximal the lower end thereof, said second plunger being comprised of a lower section and a cylindrical upper section which forms said right circular cylindrical element, said second plunger lower section having a bottom planar surface perpendicular to the axis of said bore, the area of said bottom planar surface being unequal to the area of the top base surface of said cylindrical element, and a non-deformable lower capping means, said lower capping means having a substantially planar surface facing the bottom planar surface of said second plunger lower section and being spaced therefrom a distance sufficient to permit the ready ingress of said media in the region interjacent, whereby the concomitant pressurization of said interjacent region will exert a pressure on said bottom planar surface of said second plunger lower section.

* * * * *